United States Patent [19]

Dufour

[11] Patent Number: 4,720,012

[45] Date of Patent: Jan. 19, 1988

[54] JEWELRY HOLDER

[76] Inventor: Laurette Dufour, P.O. Box 2306, Lewiston, Me. 04240

[21] Appl. No.: 928,787

[22] Filed: Nov. 10, 1986

[51] Int. Cl.[4] ..... B65D 5/50; B65D 85/30

[52] U.S. Cl. ..... 206/472; 150/113; 206/495; 206/521

[58] Field of Search ..... 63/1, 2, 12; 150/52 C, 150/52 R, 113, 131, 147–153; 190/16, 17, 110, 119, 124, 900, 902; 206/45.13, 348, 472, 523, 566, 591, 592, 593, 594, 311, 521, 493, 495

[56] References Cited

U.S. PATENT DOCUMENTS

| | | | |
|---|---|---|---|
| 364,623 | 6/1887 | Beidler | 206/472 |
| 622,819 | 4/1899 | McLane | 206/591 |
| 1,012,606 | 12/1911 | Davis | 190/16 |
| 1,360,532 | 11/1920 | Isaacs et al. | 190/16 |
| 1,564,152 | 12/1925 | Thompson | 206/472 |
| 1,622,314 | 3/1927 | Gosh | 206/473 |
| 1,719,962 | 7/1929 | Beistle | 206/475 |
| 3,525,376 | 8/1970 | Muhlhauser | 150/52 R |
| 4,274,537 | 6/1981 | Cooper | 206/523 |
| 4,287,986 | 9/1981 | Beck | 206/472 |
| 4,444,418 | 4/1984 | Goldstein | 190/16 |
| 4,465,179 | 8/1984 | Miller | 206/566 |

FOREIGN PATENT DOCUMENTS

| | | | |
|---|---|---|---|
| 0002416 | 6/1979 | European Pat. Off. | 206/594 |

*Primary Examiner*—Jimmy G. Foster
*Attorney, Agent, or Firm*—William Nitkin

[57] ABSTRACT

A device for holding and displaying jewelry of the type having attachment means such as posts and rear clips, pins and the like, having a first page of mesh material having a plurality of apertures defined therein through which apertures the attachment means such as the posts of pierced earrings can be passed and from the rear the rear clips of such pierced earrings can be inserted on the earring posts to hold the jewelry to the mesh page, a second mesh page similar in structure to the first mesh page, a separator element disposed between the first and second mesh pages being of substantially the same size as the first and second mesh pages and having cushioning on each side thereof, and a binding having front and rear cover members with cushioning on the inside of each respectively, the binding means further including means to retain the first and second mesh pages and separator element within the device. Either of the mesh pages may also have slits therein for standard earrings or the like.

9 Claims, 1 Drawing Figure

JEWELRY HOLDER

BACKGROUND OF THE INVENTION

1. Field of the Invention

This invention relates to jewelry holders and more particularly relates to a device adapted to hold and display a plurality of pierced earrings and other types of jewelry.

2. Description of the Prior Art

Jewelry is frequently kept loose in boxes or other containers. A problem that frequently arises is the quick and easy location of individual matching pieces of pairs of pierced earrings amongst all the other items kept in the box. Therefore it has been found desirable to place such items upon planar members having apertures defined therein with the shaft of the pierced earring passing though such aperture and with the rear clip affixed on the rear of the shaft holding the earring in place on the planar member, thus displaying the earrings in close proximity to one another. This storage method is a vast improvement over merely placing such jewelry loosely in a jewelry box where it often can be difficult to locate. Such a planar storage device is seen in U.S. Pat. No. 4,420,084 to Whelan entitled Jewelry Holding Device. Similar devices have been adapted for carrying in a purse such as U.S. Pat. No. 4,465,179 to Miller wherein a tab of material with apertures defined therein, through which apertures the posts of the earrings are passed and are secured to their rear clips, is held within a pouch.

SUMMARY OF THE INVENTION

It is an object of this invention to provide a new holder which is easy to use and of simple economic construction which device protects the earrings and is of reasonable cost without complex structural members that are found in the prior art which complicate and make such devices cumbersome and heavy. It is envisioned that the device of this invention can be in a plurality of sizes, both large and small, and depending upon the number of page holders desired, to accommodate the desired number of jewelry pieces.

It is a further object of this invention to provide a device in book format having a plurality of mesh pages adapted to receive the posts of pierced earrings therethrough and having cushioning means between respective successive pages with front and rear cushioned covers.

DESCRIPTION OF THE PREFERRED EMBODIMENT(S)

Figure 1:
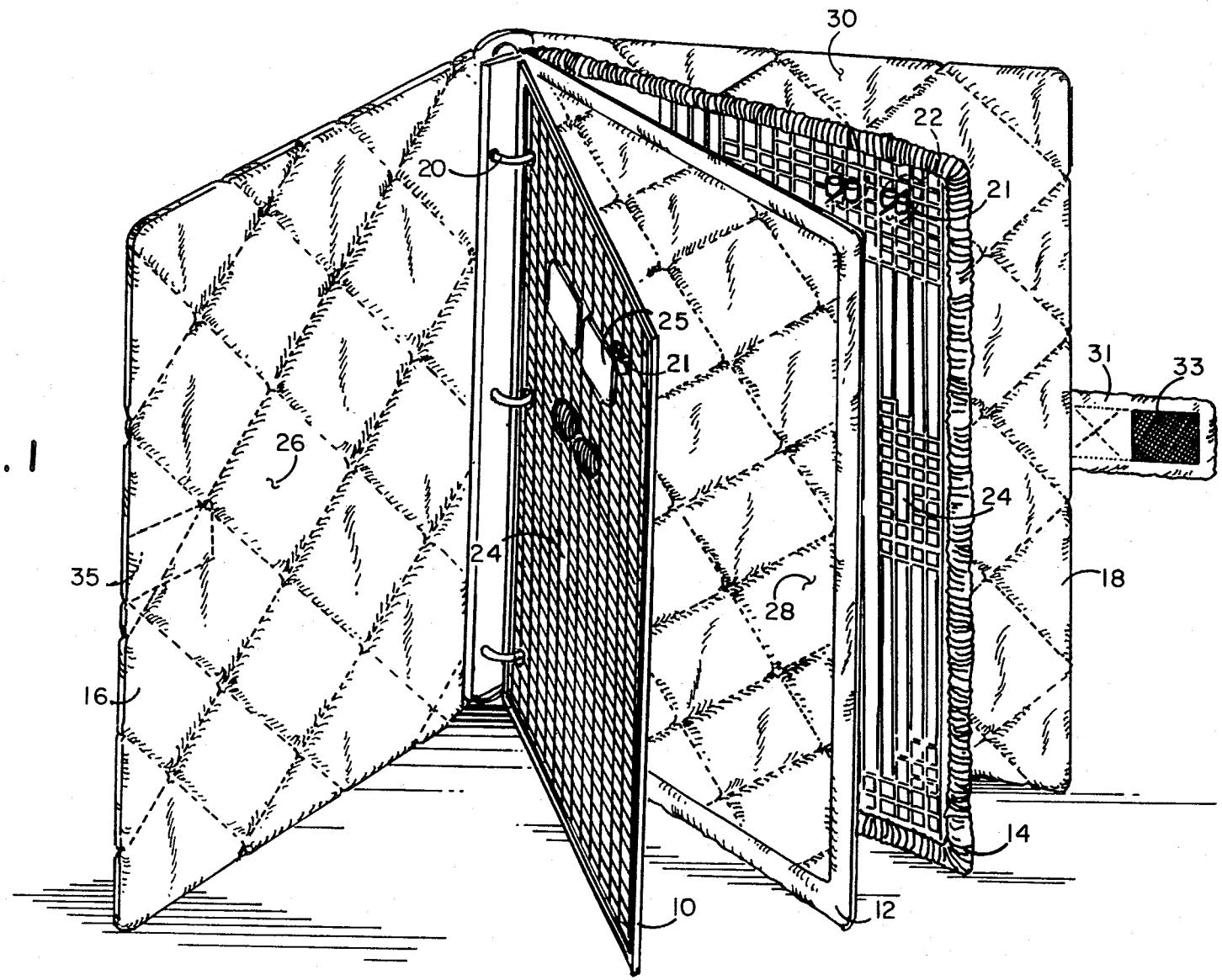
FIG. 1 illustrates a perspective view of the device of this invention in its open mode for receipt of pierced earrings and other jewelry therein.

FIG. 1 illustrates a perspective view of the device of this invention. Seen in first mesh page 10 which can be composed of a mesh-like plastic planar material having openings or apertures 11 through which the posts of earrings 22 can be passed. Rear attachment clip 21 can be inserted on one of such posts and the earrings are thereby held in place on the mesh page. Slits 24 can also be provided at various selected places in the mesh material of each page for receipt of the ear lobe catch element of standard earrings 25 to hold such standard earrings to the page. As shown in the Figure, page 10 has a slit 24 which has a maximum dimension larger than the maximum dimension of any of the openings 11. Other types of jewelry could be attached to each page such as by its pin-type attachment means or whatever type of attachment means such jewelry has. Each mesh page is bound in a portable notebook-like structure with front cover 16 which has cushioning 26 disposed on the inside thereof. First mesh page 10 is hingeably attached, for example through receiving holes 13 formed in the pages, in a three-ring binder 20, but other means of hingeably attaching mesh pages within the notebook can be used. Separator page 12 is then disposed having cushioning 28 on each side thereof and a second mesh page 14 is then provided which can have binding 32 around the edge thereof to prevent any sharp ends from the mesh page if it is of the type having clipped sides with protruding pieces from catching against anyone or anything. Rear cover 18 is provided which also has a cushioned interior side 30. The front cover 16 and the rear cover 18 can be of a size which is substantially similar to the size of the pages to allow the structure to be set on a surface such as is shown in the Figure to allow display of the jewelry held within the structure, the structure being stabilized in the surface by the covers and the pages. Mesh pages 10 and 14 can have jewelry either passed therethrough such as pierced earrings 22 held by rear clip 21 or can have slits 24 as described above to receive other types of jewelry. Cushioning 26 and 28 on front cover 16 and separator 12, respectively, provides protection means so that the jewelry is not damaged from exterior means or from jewelry affixed to the next adjacent page and further so that the jewelry does not engage against anything or protrude from the notebook-like structure. The notebook-like structure of this invention can have a stiff binding and rigid planar members within front cover 16 and rear cover 18. The covers can be held in a closed position by tab 31 on which a piece of Velcro 33 then folds around front cover 16 and mates with the opposing portion of the hook-and-loop Velcro-type attachment member 35 to releasably hold the notebook closed. In some embodiments additional mesh pages can be provided with a separator between each set of mesh pages. For example, after mesh page 14 there would be provided another separator and then a further mesh page, etc. The entire structure can be covered with a decorative fabric outside cover.

Although the present invention has been described with reference to particular embodiments, it will be apparent to those skilled in the art that variations and modifications can be substituted therefor without departing from the principles and spirit of the invention.

I claim:

1. A portable, book-like device for holding and displaying jewelry of the type having attachment means such as posts and rear clips, pins and the like, and for holding and displaying jewelry of the type having an ear lobe catch element of a standard earring, comprising:

a first page of mesh material having a plurality of apertures defined therein through which apertures the attachment means such as the posts of pierced earrings can be passed and from the rear the rear clips of such pierced earrings can be inserted on said earring posts to hold said jewelry to said mesh page, said apertures each having a size smaller than the rear clips, said apertures each having a maximum dimension;

a second mesh page similar in structure to said first mesh page, at least one of the pages having at least one slit formed therein and being adapted to receive therethrough attachment means of a piece of jewelry such as the ear lobe catch element of a standard earring in order to have said jewelry's attachment means passed through said slit to hold said jewelry piece to said selected mesh page, said slit having a maximum dimension larger than the maximum dimension of each of said apertures;

a separator element disposed between said first and second mesh pages, said separator element being of substantially the same size as said first and second mesh pages and said separator element having cushioning on each side thereof; and binding means having front and rear cover members with cushioning on the inside of each respectively, said binding means further including means to hingeably retain said first and second mesh pages and said separator element therebetween between said front and rear cover.

2. The device of claim 1 further including releasable attachment means adapted to retain, when desired, said front and rear cover members in a closed position.

3. The device of claim 2 further including a plurality of mesh pages and separator elements disposed therebetween.

4. A portable, book-like assembly for holding and displaying jewelry including pierced earrings having attachment mechanisms for attachment of the jewelry to a portion of the human body, the attachment mechanisms including post and clip mechanisms, comprising:

a first page of mesh material having a plurality of apertures defined therein, a post of a piece of the jewelry being receivable through at least one of the apertures with a clip being received on the distal end of the inserted post to hold the piece of jewelry to the mesh page;

a second mesh page capable of holding jewelry in a manner similar to that of the first page;

a separator element disposed between said first and second mesh pages, said separator element being of substantially the same size as said first and second mesh pages and said separator element having cushioning on each side thereof; and, front and rear cover members mounting the first and second mesh pages and the separator element between said front and rear cover members, the front and rear cover members being of substantially the same size as the first and second mesh pages and the separator element to allow the assembly to be placed in a stable display position on a surface with the cover members, the mesh pages and the separator element contributing to the stability of the assembly, thereby allowing facility in viewing of jewelry mounted on the mesh pages.

5. The assembly of claim 4 and further comprising:

binding means for hingeably retaining the first and second mesh pages and the separator element for turning movement between the front and rear covers.

6. The assembly of claim 4 wherein at least one of the mesh pages is capable of holding and displaying jewelry of the type having an ear lobe catch element of a standard earring as well as a post and clip attachment mechanism, the apertures in the mesh pages each having a size smaller than the clips, said apertures each having a maximum dimension, at least one slit formed in at least one of the mesh pages and being adapted to receive through the slit the ear lobe catch element of a standard earring, said slit having a maximum dimension larger than the maximum dimension of each of said apertures.

7. The assembly of claim 4 and further comprising:

a binder formed about the edge of at least one of the mesh pages for preventing catching of edge surfaces of the mesh page on any object internal or external of the assembly.

8. The assembly of claim 4 and further comprising releasable attachment means for retaining said front and rear cover members in a closed position.

9. The assembly of claim 8 and further comprising a plurality of mesh pages and separator elements disposed therebetween.

* * * * *